US007024901B2

(12) United States Patent
Yamaguchi et al.

(10) Patent No.: US 7,024,901 B2
(45) Date of Patent: Apr. 11, 2006

(54) WIRE SPRING FORMING APPARATUS

(75) Inventors: Sinichi Yamaguchi, Kanagawa (JP); Naoki Haruyama, Kanagawa (JP)

(73) Assignee: Orii & Mec Corporation, Kawanaga (JP)

( * ) Notice: Subject to any disclaimer, the term of this patent is extended or adjusted under 35 U.S.C. 154(b) by 258 days.

(21) Appl. No.: 10/679,695

(22) Filed: Oct. 7, 2003

(65) Prior Publication Data

US 2004/0211236 A1 Oct. 28, 2004

(30) Foreign Application Priority Data

Feb. 10, 2003 (JP) ..... 2003-031930

(51) Int. Cl.
*B21F 3/10* (2006.01)
*B21F 35/02* (2006.01)

(52) U.S. Cl. ..... 72/138; 72/137

(58) Field of Classification Search ..... 72/137, 72/138, 130, 131, 428, 449
See application file for complete search history.

(56) References Cited

U.S. PATENT DOCUMENTS 4,607,517 A * 8/1986 Finzer et al. ..... 72/449
6,397,900 B1 * 6/2002 Sautter et al. ..... 140/71 R
2002/0108420 A1 * 8/2002 Itaya ..... 72/137

* cited by examiner

*Primary Examiner*—Derris H. Banks
*Assistant Examiner*—Debra Wolfe
(74) *Attorney, Agent, or Firm*—Nixon Peabody LLP

(57) ABSTRACT

A high-speed wire spring forming apparatus capable of easily adjusting a coil diameter is provided that includes: a wire feeder having a pair of feeding rollers for feeding a wire to a spring forming stage via a quill serving as a wire guide; a revolving mechanism for revolving the feeding rollers about the axis of the wire to twist the wire fed out of the leading end of the quill to change the circumferential position, or angular position, of the wire; and a multiplicity of spring forming tools arranged radially on a spring forming stage, each of the spring forming tools movable in a direction substantially perpendicular to the axis of the wire.

8 Claims, 15 Drawing Sheets

WIRE SPRING FORMING APPARATUS

FIELD OF THE INVENTION

The invention relates to an apparatus for forming a wire spring, the apparatus having a multiplicity of radially arranged spring forming tools that can be advanced to a spring forming stage, perpendicularly to the axis of a wire fed or guided by a quill mounted on the spring forming stage, until the tools abut the wire provided at the leading ends of the quill, thereby forming the wire spring.

BACKGROUND OF THE INVENTION

Japanese Patent Early Publication H10-29028 discloses an apparatus having means for feeding a wire including feeding rollers from a front quill to a spring forming stage, and multiple types of radially arranged spring forming tools, which can be advanced perpendicularly or substantially perpendicularly to the axis of the wire towards the spring forming stage until they abut the wire coming out of the quill. The spring forming tools are mounted on a swivel table and can be positioned at predetermined angular positions by turning the swivel table through predetermined angles. By advancing and retreating the spring forming tools in turn on the swivel table, the tools may abut the wire, bend it, curve it, or wind it to form a spring.

In this prior art wire spring forming apparatus, the radius of a coil of a spring can be varied by adjusting the distance from the quill (wire guide) to the tools that abut the wire in the process of forming the coil. A large distance is used to form a coil of a large diameter and conversely a small distance is used to form a coil of small diameter.

However, the above-mentioned prior art apparatus has a drawback in that in adjusting the radius of the coil it is necessary to adjust the positions of the spring forming tools with respect to the quill by manipulating screws provided on the spring forming tools (Literature 1, Paragraph 0022 and FIG. 8), which is very tedious.

The prior art has another drawback in that the swivel table is provided with a set of 7 or 8 spring forming tools to attain high production efficiency. Hence, the entire swivel table, including its drive mechanism, has a considerably large moment of inertia. It is noted that the drive mechanism of each spring forming tool is set to have full advancing and receding strokes in order to prevent the mechanism from being damaged during its operation. Furthermore, each of the spring forming tools is programmed to be advanced only after the angular position of the swivel table is determined, and the swivel table is turned only after the relevant spring forming tool has finished its receding stroke. Because of the large amount of time involved in such processes and large moment of inertia of the spring forming tools, the production rate of the prior art spring forming apparatus is substantially lower than it might otherwise be. To overcome the difficulties associated with the simple advancing and retreating of spring forming tools as mentioned above, in which the wire is prevented from being scratched during the formation of a spring, it is also known to provide bending tools having a rotary body mounted on a mandrel and having projections on the periphery thereof. In order to mount this type of bending tool on the swivel table, two servomotors are provided to advance and retreat the tool and to rotate the bending tool. However, if more than one (2 say) such bending tools are mounted on the swivel table, an excessively large moment of inertia will result, so that in actuality only one bending tool can be mounted, which limits the production rate.

OBJECT OF THE INVENTION

It is, therefore, an object of the invention to overcome prior art problems mentioned above by providing a spring forming apparatus having a high production rate and being capable of easily adjusting the diameter of a coil spring to be formed.

SUMMARY OF THE INVENTION

The inventor has found that the aforementioned problems associated with prior art spring forming apparatuses can be solved as follows. First, rotation of the swivel table constituting a spring forming stage can be circumvented. This can be attained by allowing the feeding rollers holding the wire therebetween to revolve about the axis of the wire before a linear material, such as wire is fed therefrom to a spring forming stage ahead via a quill, thereby twisting and re-orienting the linear material. Thus, a multiplicity of bending tools need not be rotated and can be mounted on the table. This solution overcomes the second of the above-mentioned problems of low production rate. The first problem can be solved by providing a quill that can be moved in the axial direction of the linear material and electric motors adapted to numerically control the distance between the quill and the spring forming tools, thereby eliminating tedious manipulation of screws for adjusting the diameter of a coil to be formed. A trial spring forming apparatus based on these findings has been proven very efficient. Thus, the inventor has reached an inventive spring forming apparatus as disclose herein.

More specifically, the invention comprises a spring forming apparatus that includes:

means for forcibly feeding a linear material such as wire (referred to as wire feeding means) having at least a pair of feeding rollers for feeding the wire held therebetween to a spring forming stage located ahead via a quill; revolving means for revolving the feeding rollers about the axis of the wire to twist the wire fed out of the leading end of the quill, thereby changing the circumferential position, or angular position, of the wire relative to the spring forming stage; and a multiplicity of spring forming tools arranged radially on the spring forming stage, each of the spring forming tools movable to and from the wire in a direction perpendicular or substantially perpendicular to the axis of the wire, the wire spring forming tools adapted to advance to abut on the wire fed out of the quill to the spring forming stage so as to bend, curve, or wind the wire, thereby forming a wire spring, wherein the quill is movable in the axial direction of the wire by the action of quill moving means; and motions of the wire feeding means, revolving means, and quill moving means are controllable.

As the pair of feeding rollers (of the wire feeding means) is revolved about the axis of the of wire, the wire held between the feeding rollers is twisted, thereby varying the angular position of the wire fed from the quill relative to the spring forming stage. Hence, by appropriately pre-setting the amount of revolution of the revolving means, the wire is twisted to an optimum angular position to abut on a predetermined one of the radially arranged spring forming tools. Thus, unlike in conventional apparatuses, the wire fed to the spring forming stage can be precisely bent, curved, and turned to form a coil spring without rotating the swivel table and generating a large moment of inertia.

It will be appreciated that by axially moving the quill by means of quill drive means, the distance between the quill and the spring forming tool, and hence the diameter of the coil formed, can be varied accordingly. As a result, the diameter of the coil can be freely changed by appropriately pre-setting the axial position of the quill driven by the quill drive means.

In accordance with another aspect of the invention, the wire spring forming apparatus may be characterized in that:

the quill moving means is a linear way slide table;

the quill is rotatable about the axis of the wire by means of quill rotating means; and the quill rotating means, wire feeding means, and revolving means are axially fixed on the linear way slide table.

The quill alone can change its angular position while serving as a wire guide when rotated through a predetermined angle by means of the quill rotating means.

In accordance with still another aspect of the invention, the wire spring forming apparatus may also be characterized in that:

the spring forming tools are radially arranged, angularly spaced apart at regular angular intervals, on the front end of a main plate that constitutes the spring forming stage, each of the spring forming tools having a tool slide table driven in the radial direction thereof by a first servomotor via a crank mechanism to and away from the spring forming table;

the main plate has on the backside thereof a rotatably supported ring gear that surrounds the spring forming stage and driven by a second servomotor mounted on the main plate;

the tool slide table that constitutes a bending tool is provided with a rotational bending unit, and a power transmission gear mechanism is provided between the rotational bending unit and the ring gear to transmit the torque of the ring gear to the rotational bending unit without interfering the advancing and receding motions of the tool slide table.

As an example, the rotational bending unit can be formed of (1) a fixed mandrel having a groove formed in the front end thereof facing the axis of the wire, and (2) a rotary body having a protrusion formed on the front end thereof for engagement with the wire (the protrusion referred to as wire engaging projection) and rotatably supported on the periphery of the fixed mandrel.

In the invention, the torque of a ring gear driven by a single second servomotor is transmitted to a multiplicity of rotational bending units arranged on the main plate via respective power transmission gear mechanism mounted between the main plate and the respective rotational bending units, thereby rotating the respective rotational bending units. The rotational motion of the bending tool does not interfere with the advancing and receding motions of the slide tables, so that the bending tools can be individually advanced, retreated, and rotated freely at any time.

It is noted that although all the rotational bending units mounted on the main plate, including those bending tools currently not in operation, are rotated, there are at most four bending tools and the load imposed on the second servomotor is not very large as compared with the load that would be imposed on individual servomotors provided for individual bending tools. Hence, smooth and speedy rotation of the ring gear can be attained by the second servomotor.

In order to reduce the bending stress on the main plate due to the weight of the second servomotor and to ensure stability of the main plate, the second servomotor is preferably mounted at a position below the main plate for which the center of gravity of the entire plate is sufficiently low.

In accordance with a further aspect of the invention, the wire spring forming apparatus may also be characterized in that:

the power transmission gear mechanism has a drive shaft installed on the main plate in parallel with the sliding direction of the tool slide table and a coaxial driven shaft installed on the rotational bending unit such that the drive shaft and driven shaft are mutually slidable in the coaxial direction but locked in the circumferential direction.

In the operably connected section of the drive shaft mounted on the main plate and the driven shaft coaxial with the drive shaft, the driven shaft can axially slide relative to the drive shaft, allowing the tool slide plate to smoothly advance and recede. On the other hand, the torque of the ring gear is transmitted to the rotational bending unit via the coaxial drive shaft and driven shaft, since they are locked in the circumferential direction.

In a case where the drive shaft mounted on the main plate is a circular cylinder housing therein the coaxial driven shaft of the rotational bending unit in keyed engagement with each other by means of a key and a spline groove respectively formed on the inside and outside of the drive shaft and the driven shaft, secure spine engagement of the shafts can be obtained that provides proper axial sliding displacement of one shaft to another while locking them in the circumferential direction. Such spline engagement is compact in size but may provide a long reach in the axial direction.

The wire spring forming apparatus may further be characterized in that holes for installing the respective transmission gear mechanisms are formed in the main plate at regular angular intervals.

Holes for mounting power transmission gear mechanisms are formed in the main plate at the positions (angularly spaced at regular intervals) where the respective spring forming tools are mounted, so that any bending tool may be arranged at these positions.

The wire spring forming apparatus may further be characterized in that each of the tool slide tables constituting a coil forming tool is provided with a tool rotating unit having a pair of dextral and sinistral coil forming work heads mounted on a rotatable tool holder having a rotary shaft oriented in the direction parallel to the advancing/receding direction of the tool slide table, the coil forming work heads opposing each other across the rotary shaft; and a third servomotor is provided for rotating the tool holder.

The initial tension of wire forming a coil can be adjusted by shifting the wire engaging groove of the coil forming work heads by a predetermined distance relative to the wire. This can be done by rotating the third servomotor only slightly while forming the coil. In this coil forming tool, dextral and sinistral coil forming work heads to be engaged with the wire on the spring forming stage can be switched by actuating the third servomotor.

DETAILED DESCRIPTION OF THE EMBODIMENTS

The invention will now be described in detail by way of examples with reference to the accompanying drawings.

Figure 1:
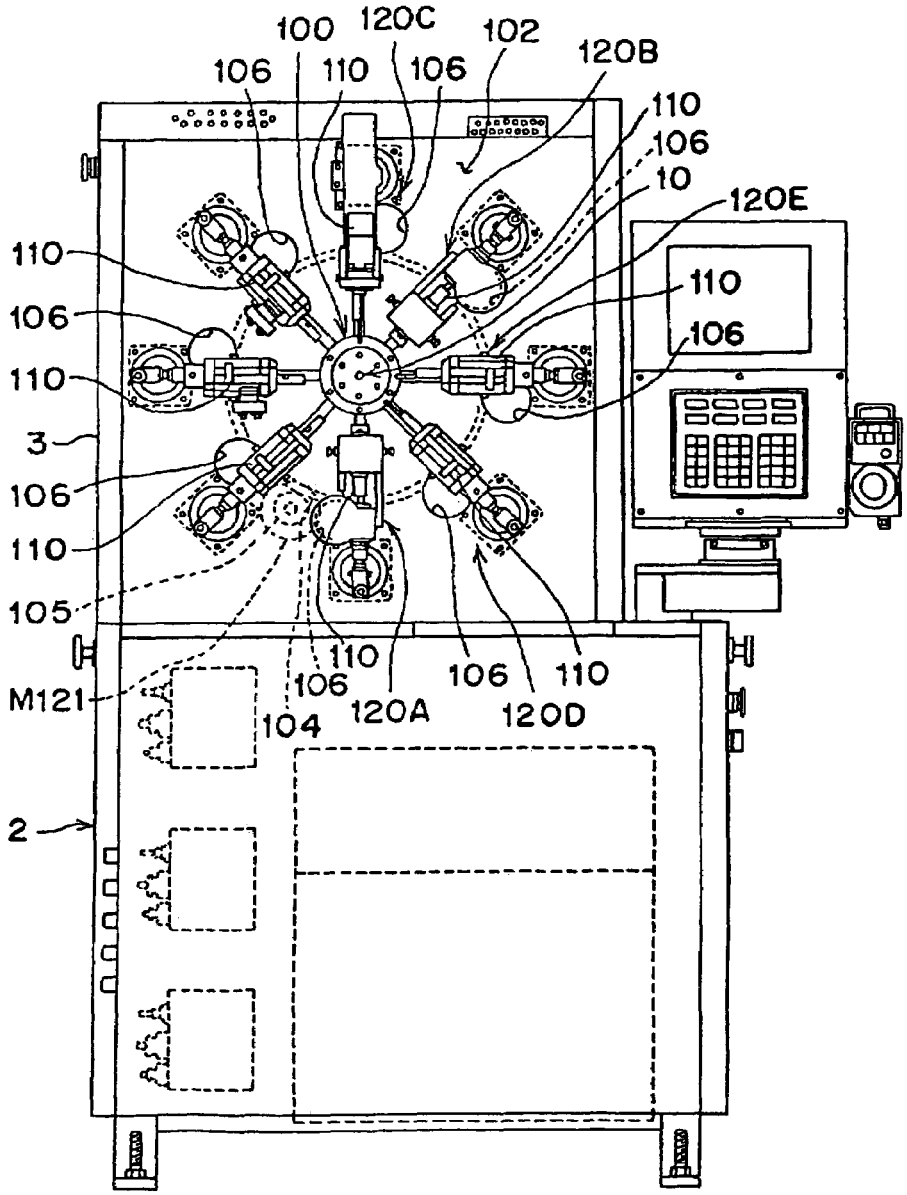
FIG. 1 is a front view of the entire spring forming apparatus according to a first embodiment of the invention.
Figure 2:
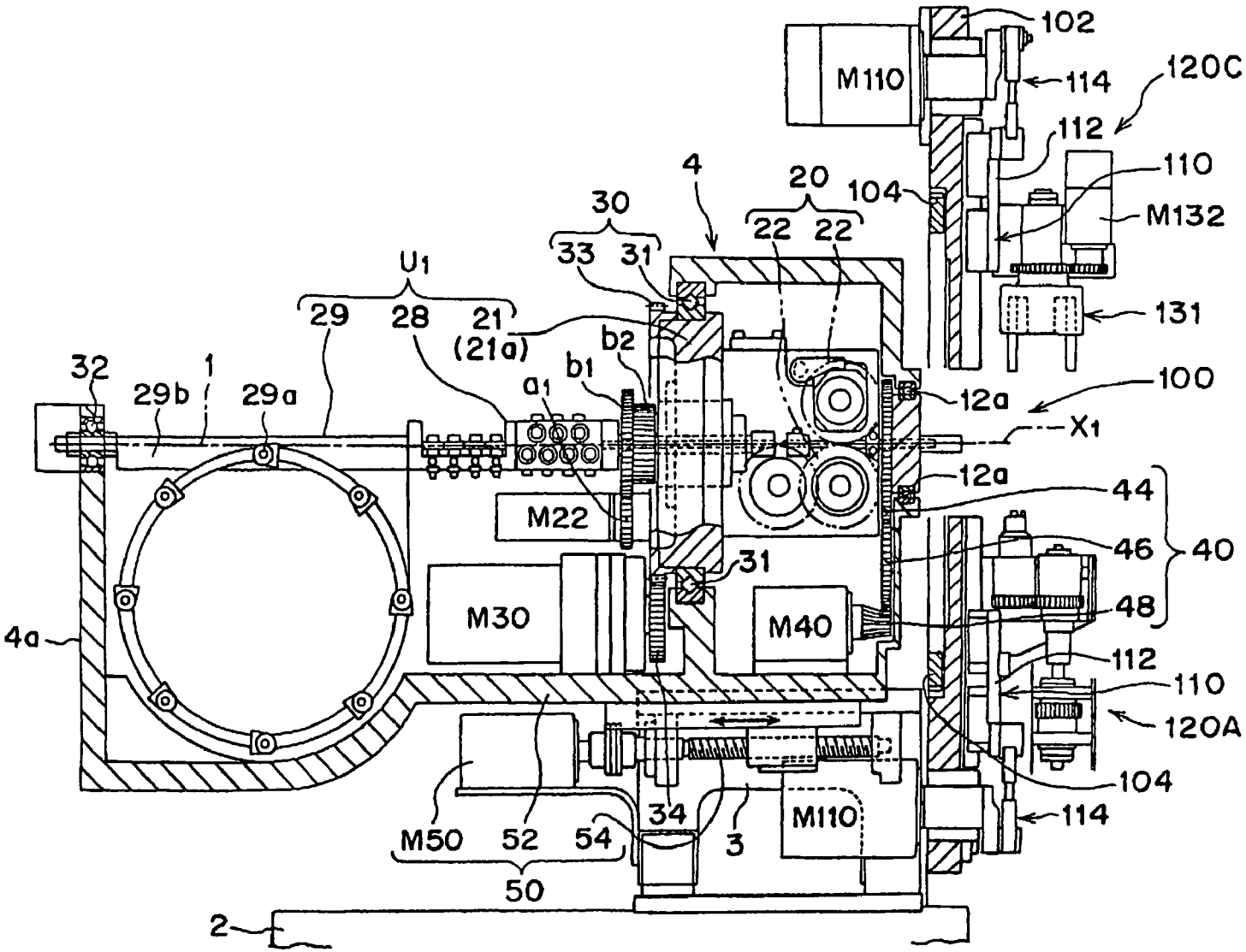
FIG. 2 is a left side view, partially shown in cross section, of the apparatus shown in FIG. 1.
Figure 3:
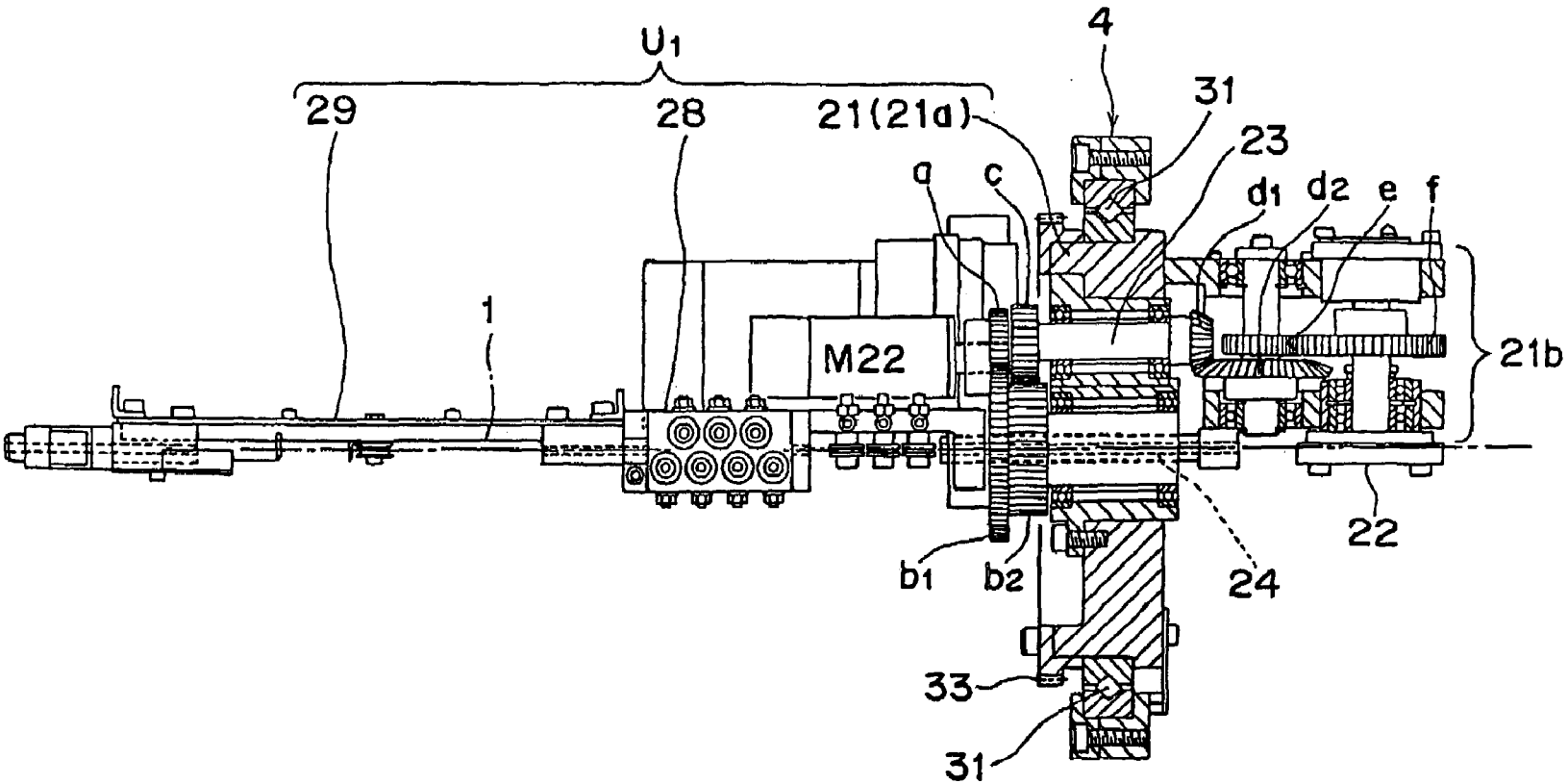
FIG. 3 is a horizontal sectional view of a portion of the apparatus including a rotational frame.
Figure 4:
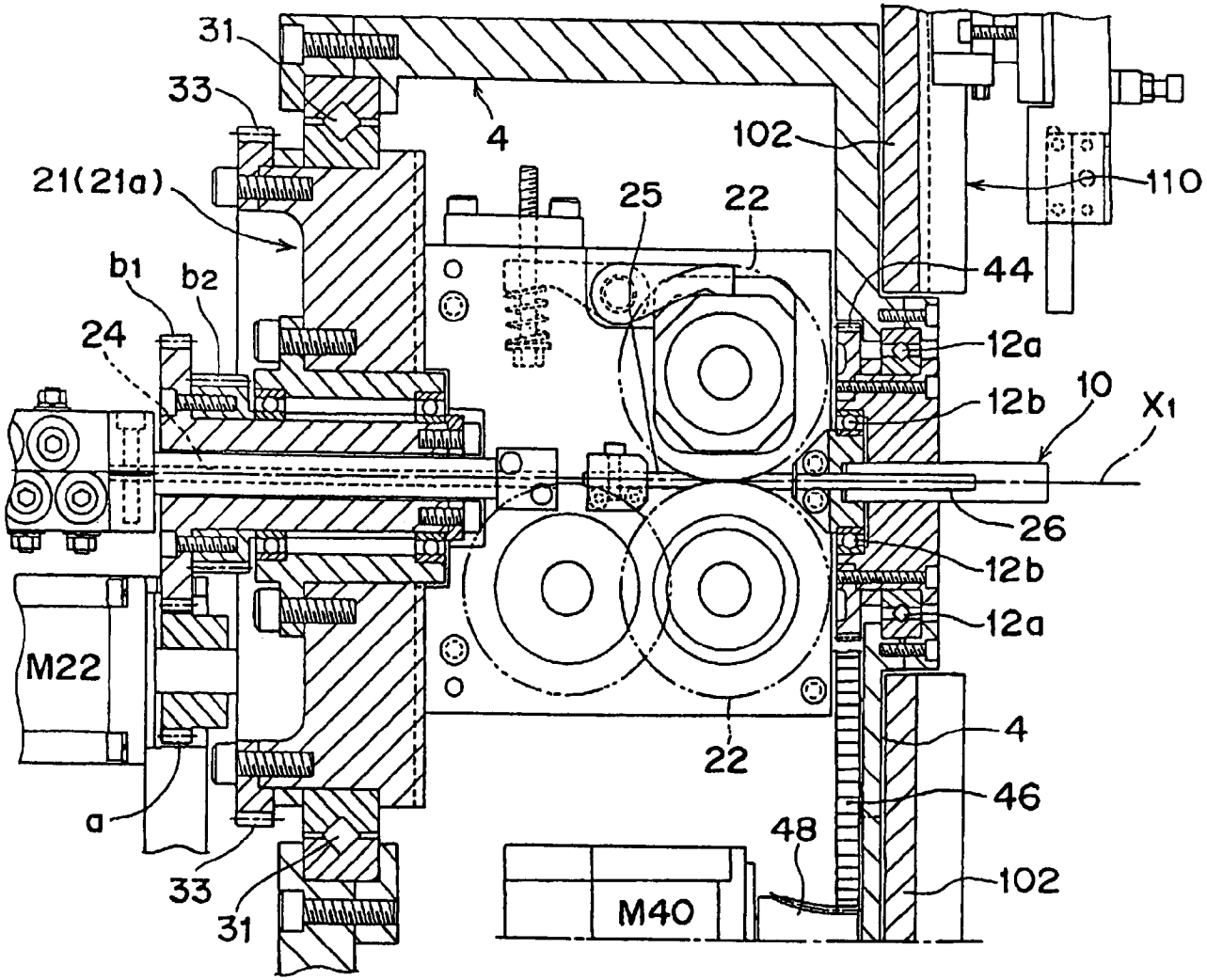
FIG. 4 is an enlarged sectional view near a quill of the apparatus.
Figure 5:
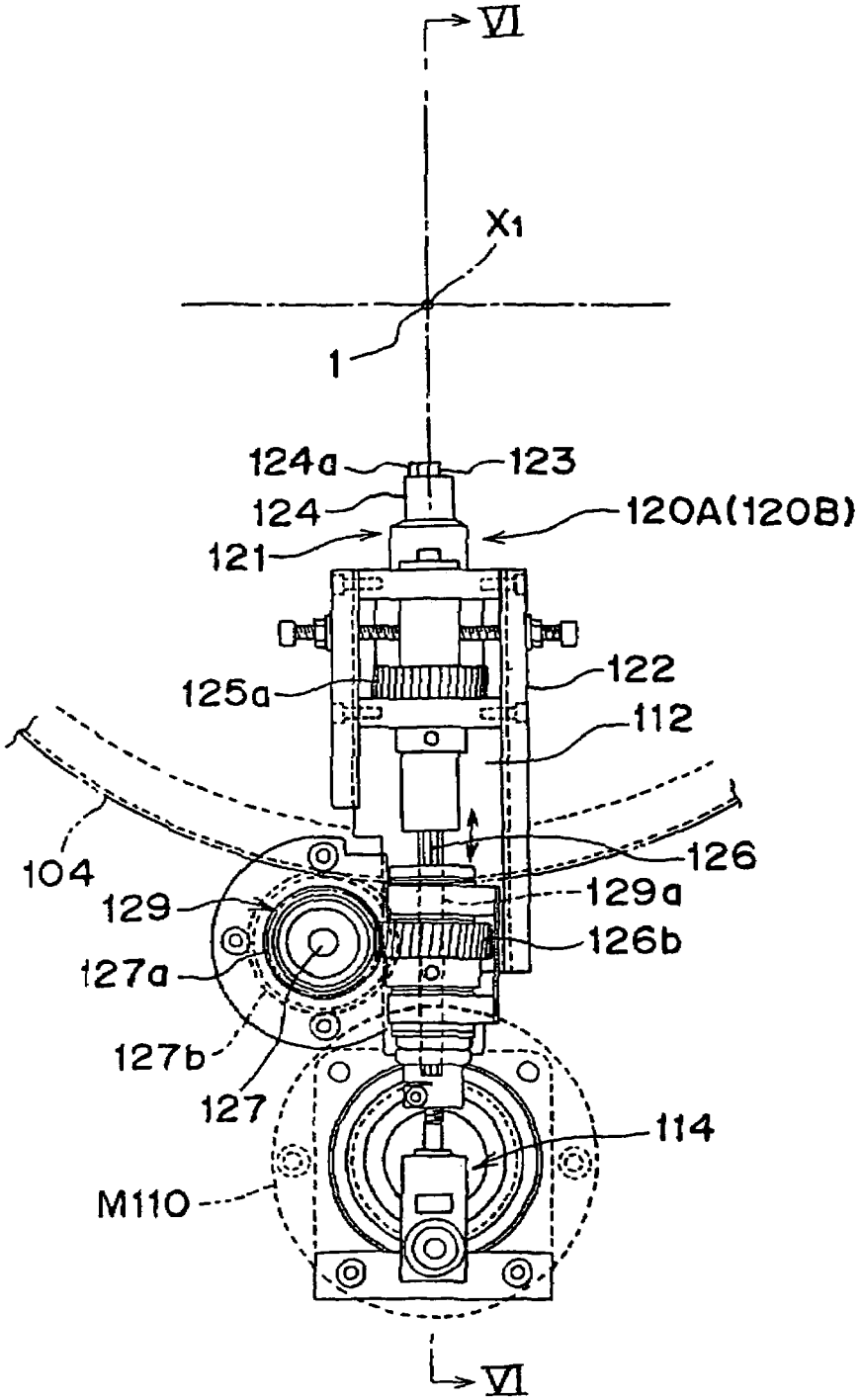
FIG. 5 is a front view of a bending tool of the apparatus.
Figure 6:
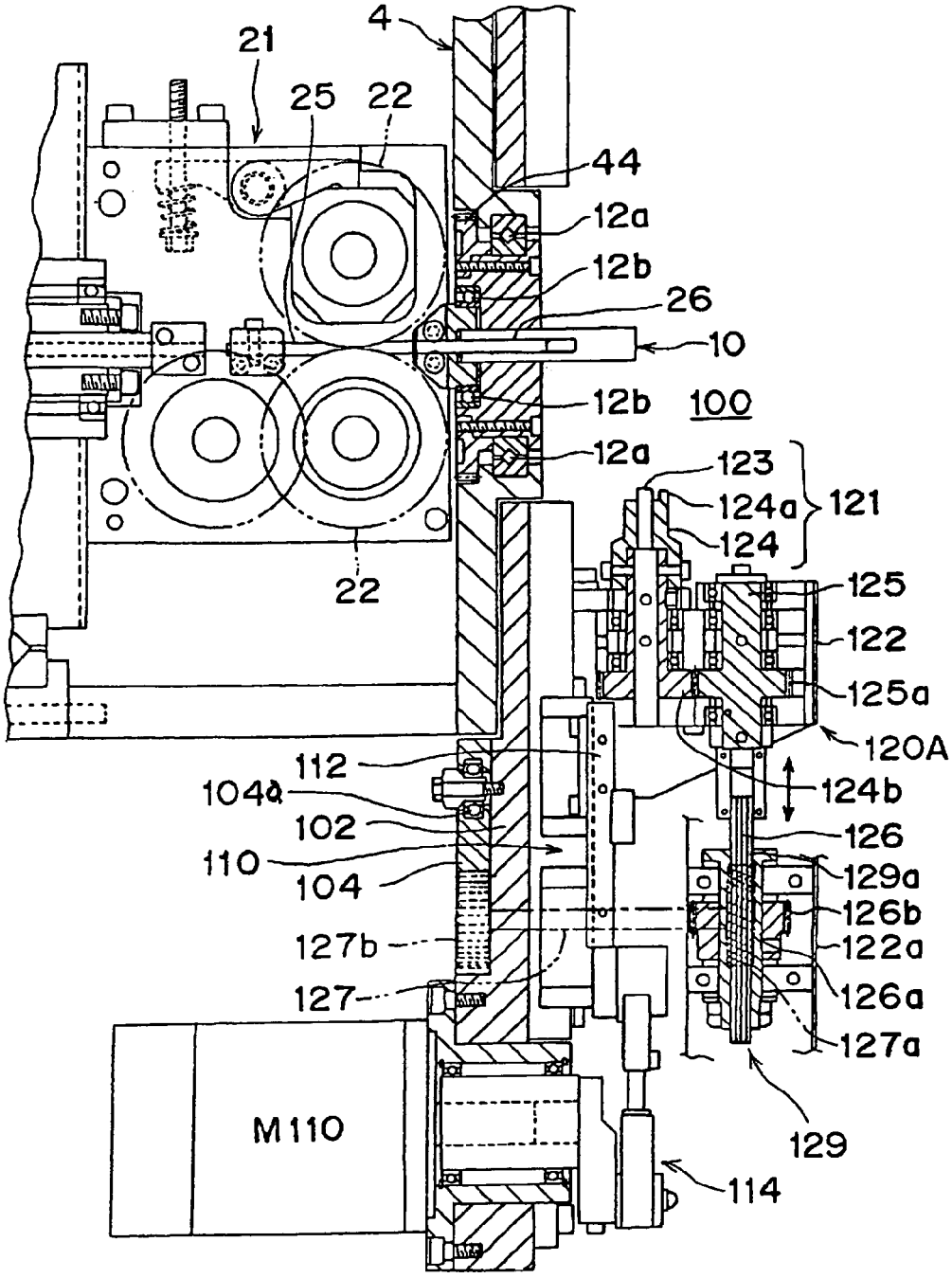
FIG. 6 is a longitudinal sectional view of the bending tool taken along line VI—VI of FIG. 5.
Figure 7:
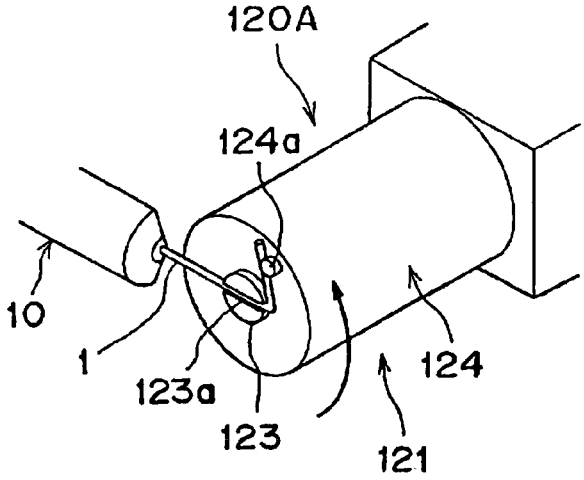
FIG. 7 is a perspective view of a main section of the bending tool.
Figure 8:
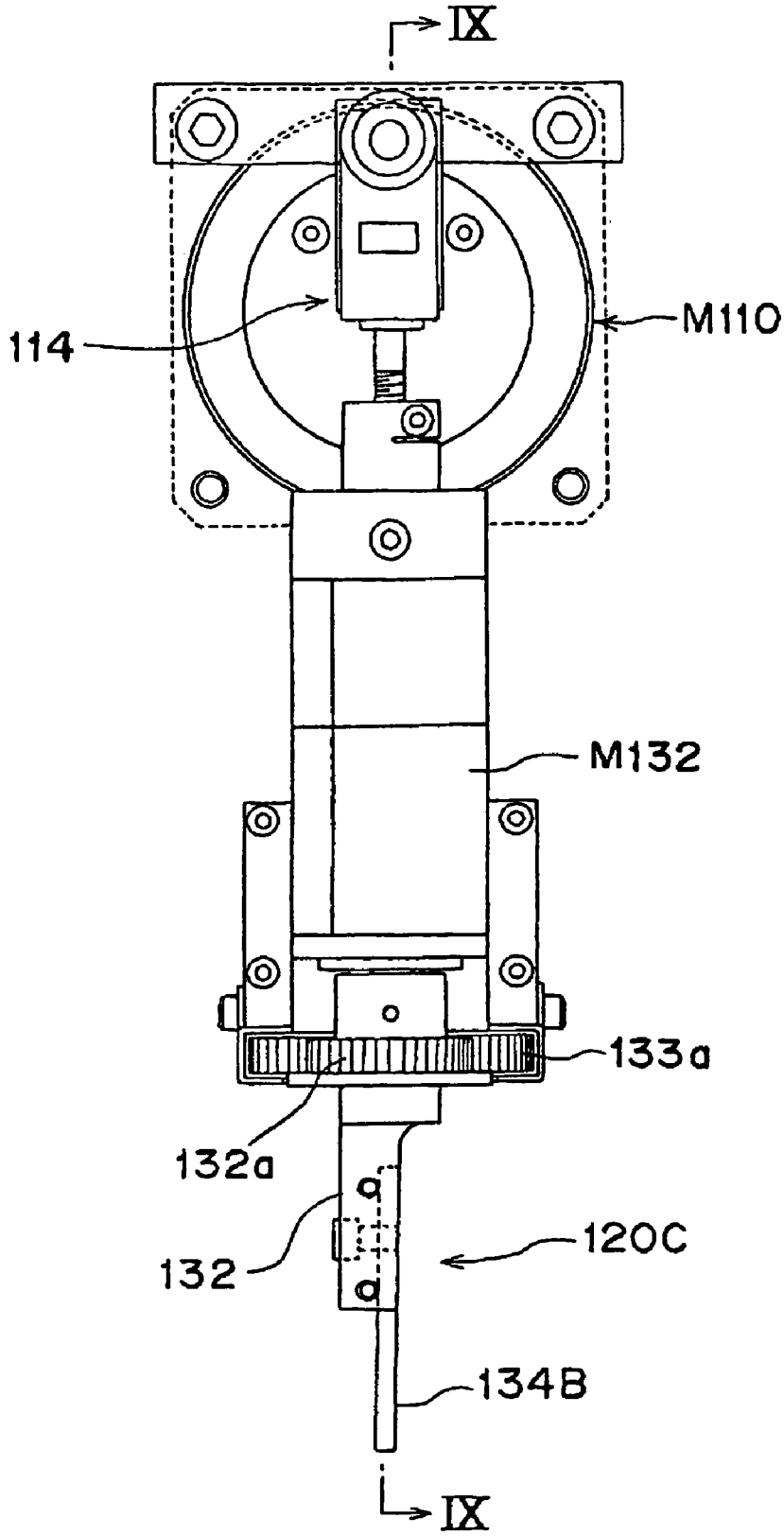
FIG. 8 is a plan view of a coil forming tool.
Figure 9:
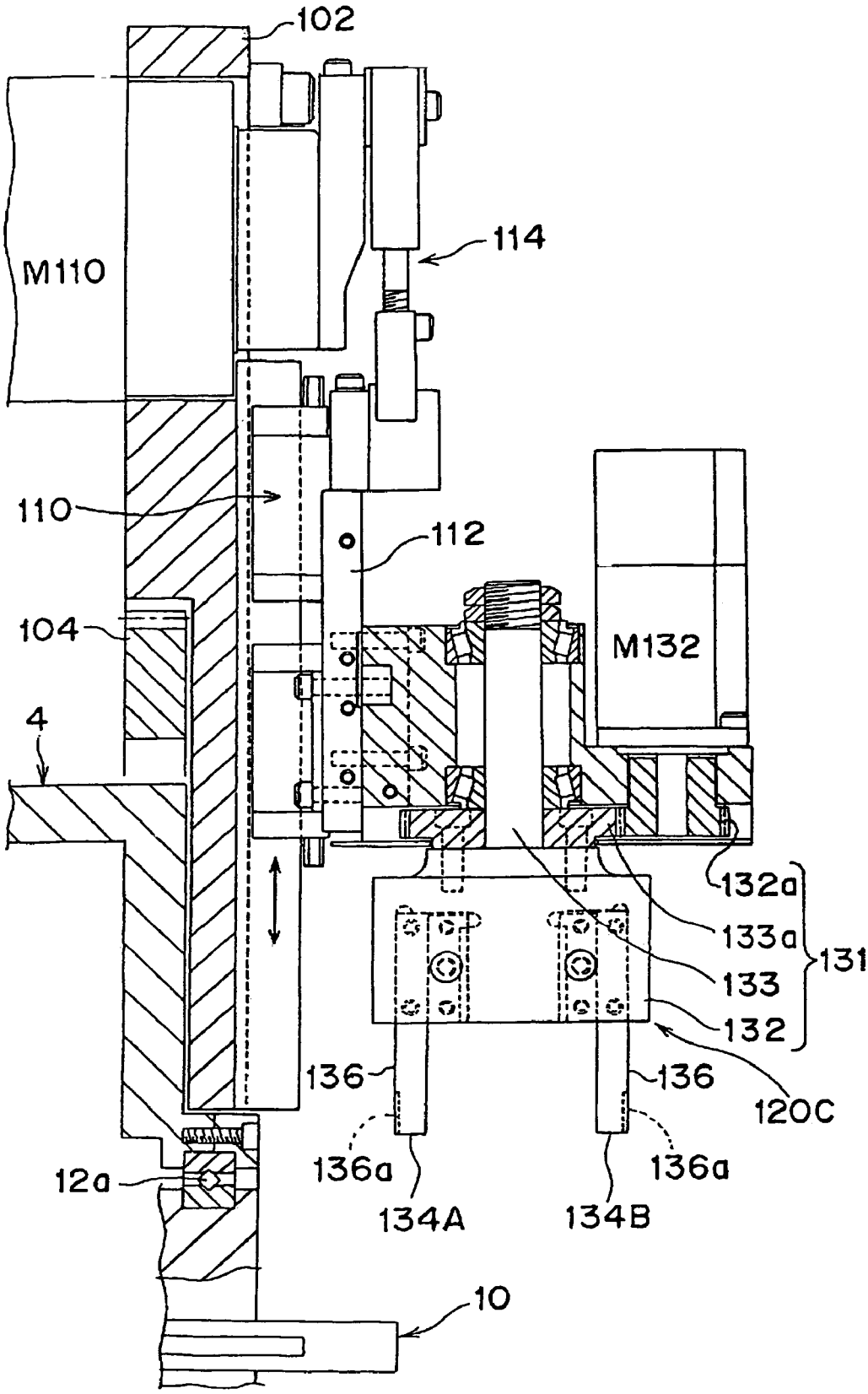
FIG. 9 is a longitudinal sectional view of the coil forming tool taken along line IX—IX of FIG. 8.
Figure 10:
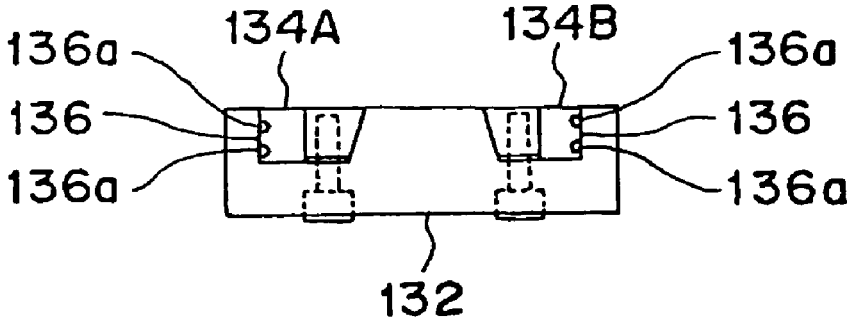
FIG. 10 shows an arrangement of a dextral and a sinistral coil forming work heads formed on a tool holder.
Figure 11:
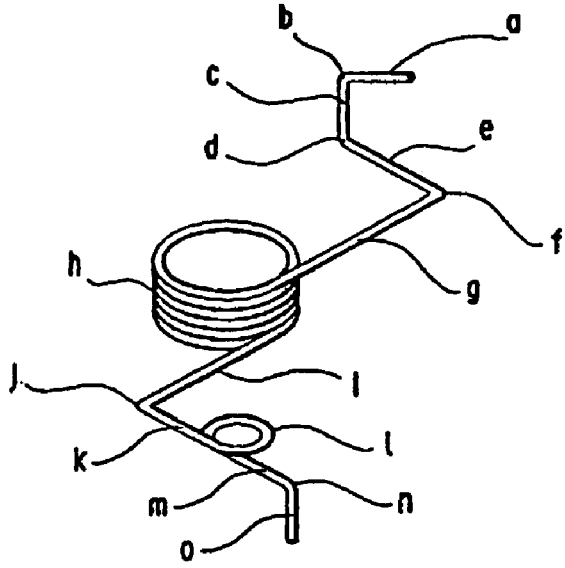
FIG. 11 shows an example of spring formed by the spring forming apparatus.
Figure 12:
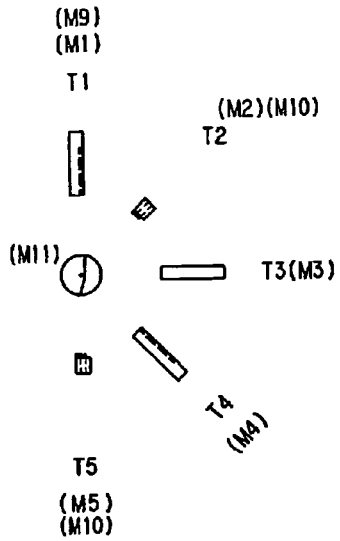
FIG. 12 shows an arrangement of different types of spring forming tools located on the respective spring forming stages.
Figure 13:
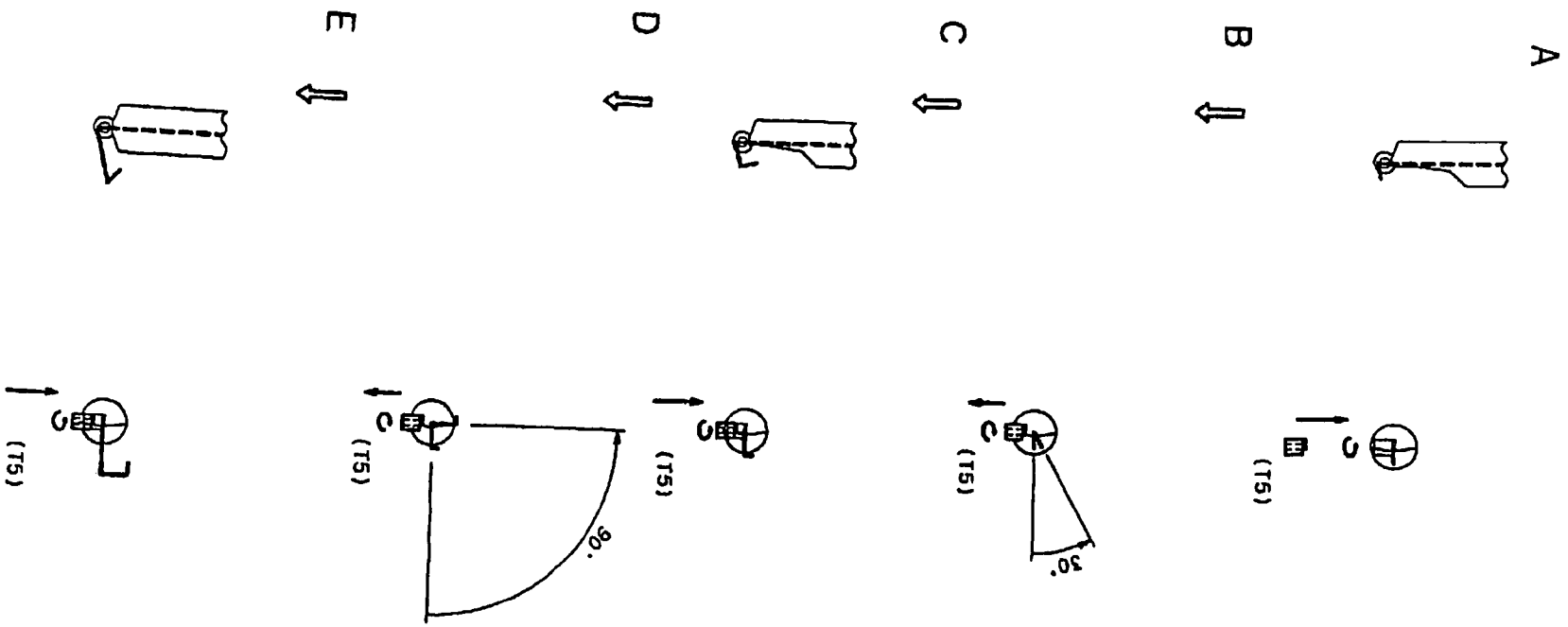
FIGS. 13–15 together show steps of forming a wire spring shown in FIG. 11.
Figure 14:
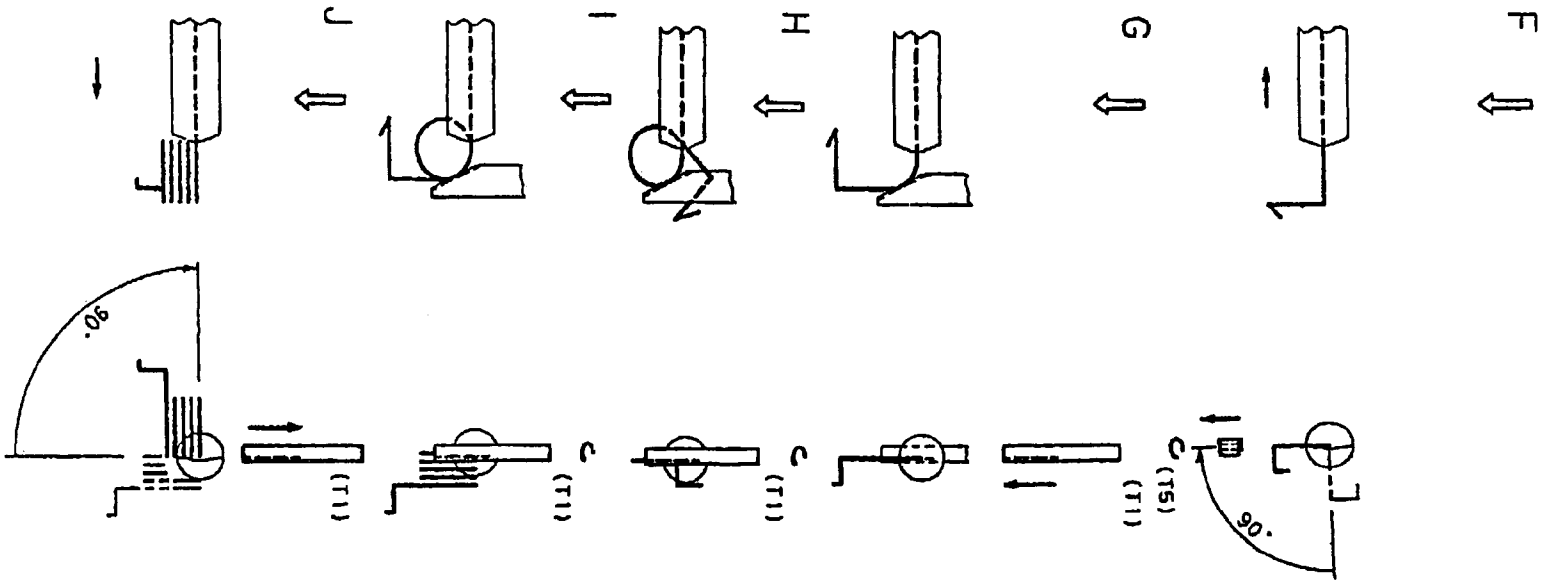
Figure 15:
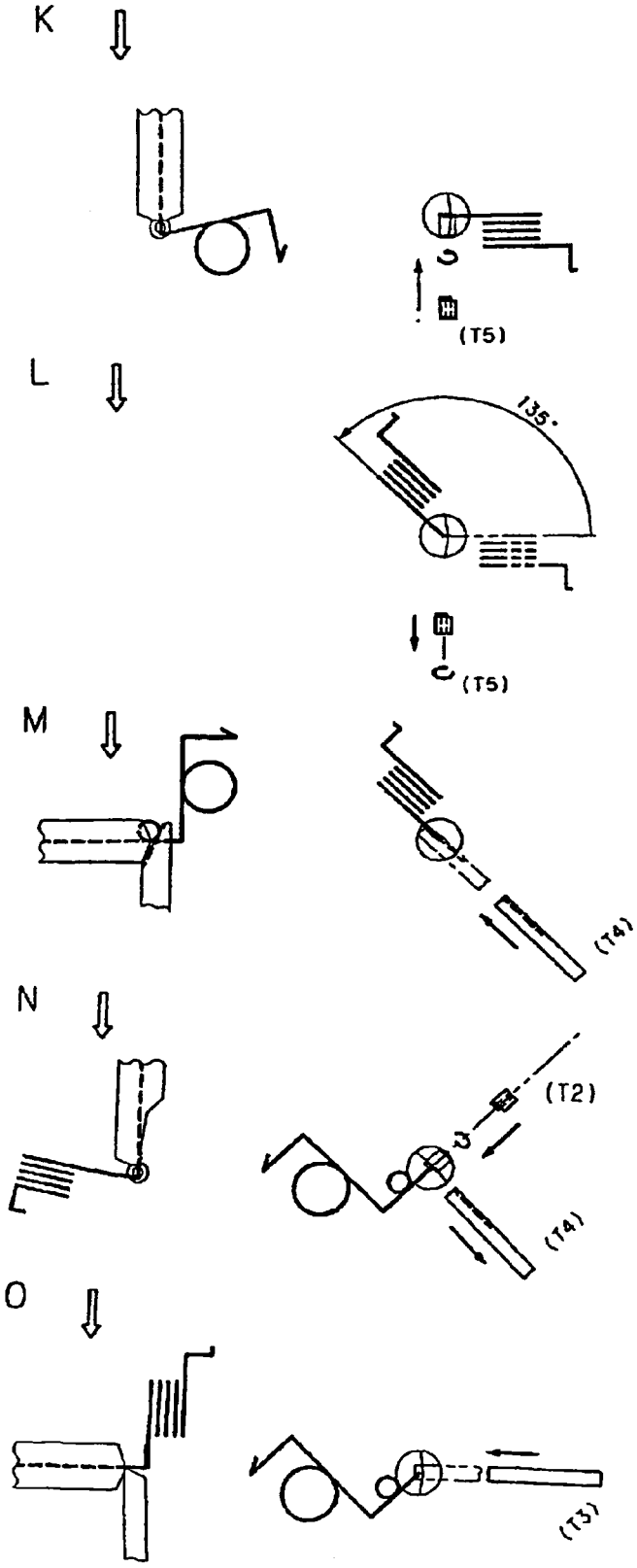
Figure 16:
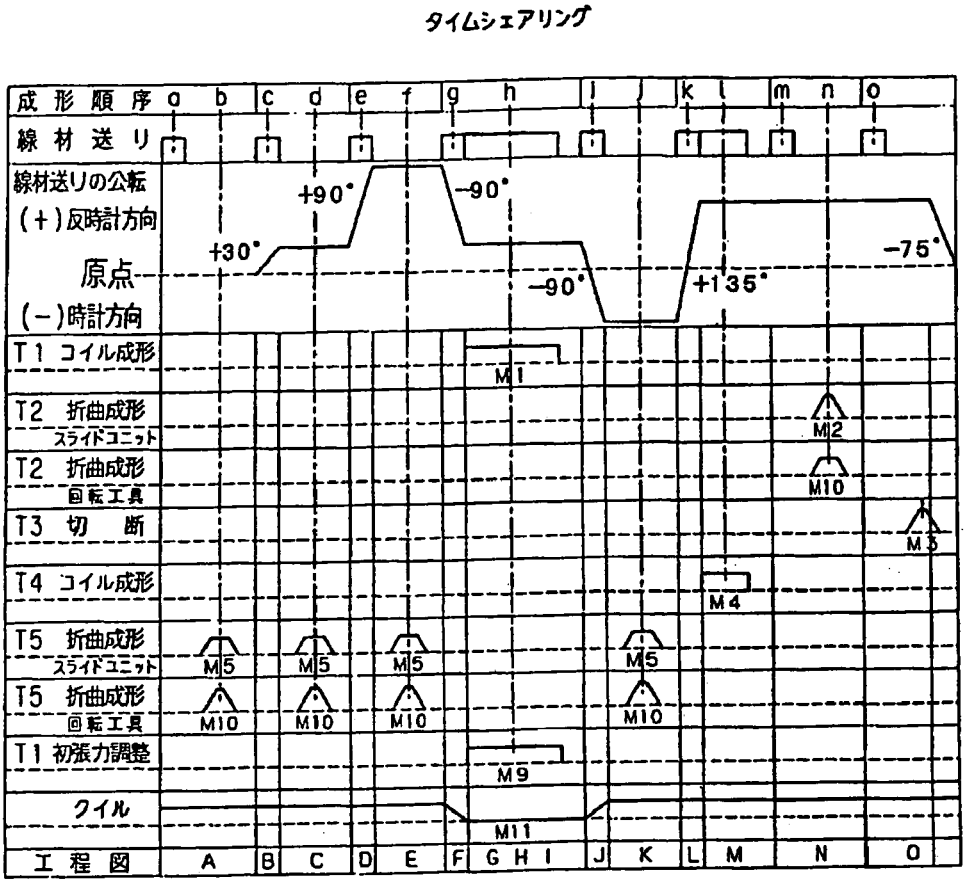
FIG. 16 shows a time-sharing scheme in the spring forming steps for the spring shown in FIG. 11.

FIGS. 1–16 show a spring forming apparatus in accordance with a first embodiment of the invention. More particularly, FIG. 1 shows a front view of the apparatus; FIG. 2 shows a left elevation, partly in cross section; FIG. 3 shows a horizontal cross section of a portion of the apparatus including a rotational frame; FIG. 4 shows an enlarged cross section of the apparatus near the quill; FIG. 5 shows a front view of a bending tool of the spring forming apparatus; FIG. 6 shows a longitudinal cross section of the bending tool taken along line VI—VI of FIG. 5; FIG. 7 shows a perspective view of the main section of the bending tool; FIG. 8 shows a plan view of a coil forming tool; FIG. 9 shows a longitudinal cross sectional of the coil forming tool taken along line IX—IX of FIG. 8; FIG. 10 shows an arrangement of a dextral and a sinistral coil forming work heads formed on a tool holder; FIG. 11 shows a perspective view of a spring formed by the spring forming apparatus; FIG. 12 shows an arrangement of different spring forming tools on a spring forming stage; FIGS. 13, 14, and 15 together show a process of forming a spring shown in FIG. 11; FIG. 16 shows a time sharing scheme in the process of forming the spring shown in FIG. 11.

While the embodiment of the invention is described with respect to a feeding means and feeding guide for wire, it should be noted that the invention encompasses a spring forming apparatus capable of forming a spring from any suitable linear material regardless of the specific cross sectional shape of the linear material.

As shown in these figures, the spring forming apparatus comprises:

a feeding means 20 having a pair of feeding rollers 22 for feeding a linear material such as a wire 1 held between them via a quill 10 serving as a wire feeding guide to a forward spring forming stage 100 (FIGS. 1, 2, and 6); a revolving means 30 for revolving the wire feeding means 20 about the axis X1 of the wire 1 to twist the wire 1, thereby varying the angular position, relative to the spring forming stage 100, of the wire 1 fed from the leading end of the quill 10;

a quill rotating means 40 for rotating the quill 10 about the axis X1 of the wire 1;

a multiplicity (5 in the example shown herein) of spring forming tools 120 (120A–120E) radially arranged on the spring forming stage 100 and capable of advancing and receding at right angles or substantially right angles to the axis X1 of the wire 1, wherein the spring forming tools 120 are advanced to abut on the wire 1 so as to bend, curve, or turn the wire 1, thereby forming a wire spring.

A rectangular platform 2 shown in FIGS. 1 and 2 supports from below the revolving means 30, the quill rotating means 40, and the spring forming stage 100 and houses therein a multi-shaft numerical control unit for numerically controlling the servomotors driving the wire feeding means 20, revolving means 30, and quill rotating means 40 as well as other drive means of the wire spring forming apparatus in coordination.

Mounted on the platform 2 is a fixed frame 3, which is integral with a vertically mounted main plate 102 that constitutes the spring forming stage 100, such that the axis X1 of the wire 1 is aligned with the center of the main plate main plate 102.

Provided on the fixed frame 3 is a linear way slide (quill moving means) 50 (FIG. 2) for advancing and retreating the quill along the axis X1 of the wire 1. That is, assembled on the fixed frame 3 is a slide table 52 which is slidable along the axis X1 of the wire 1. The wire feeding means 20, the revolving means 30, and the quill rotating means 40 are integrally mounted on the slide table 52 via a slide frame 4. The slide table 52 can be advanced and retreated along the axis X1 of the wire 1 by means of a ball screw 54 which is driven by a servomotor M50 mounted on the fixed frame 3. In forming a wire spring by advancing predetermined spring forming tools 120 towards the spring forming stage 100 and engaging with the wire 1 fed from the quill 10 to bent, curve, or turn the wire 1, the diameter of the coil spring may be freely regulated by adjusting the shifted position of the slide table 52 (or quill 10) through numerical control of the servomotor M50, since the diameter of the coil spring is proportional to the distanced between the spring forming tool 120 and the quill 10.

As shown in FIGS. 2–4, the wire feeding means 20 has a pair of feeding rollers 22; a servomotor M22 for driving the feeding rollers (referred to as feeding roller driving servomotor); a gear mechanism having gears "a–f" for transmitting the driving power of the servomotor M22 to the feeding rollers 22; an ordinary wire correction mechanism 28, mounted in the downstream of the feeding rollers 22, for correcting bending of the wire 1; and a guide ring mechanism 29 having a few guiding rollers 29*a* for holding the wire 1 oriented in a predetermined direction and feeding the wire 1 to the wire correction mechanism 28.

The slide frame 4 rotatably supports the disk section 21*a* of a rotary frame 21 via cross roller bearings 31. A rectangular gear housing section 21*b* (FIG. 3) is provided, offset from a hole 24 formed at the center of the disk section 21*a* for passing therethrough the wire, whereby the feeding rollers 22 are mounted on one side of the gear housing section 21*b* such that their wire feeding path is aligned with the hole 24. The driving force of the servomotor M22 fixed on the disk section 21*a* is transmitted to the feeding rollers 22 via the gear mechanism (gear train) composed of the multiple gears a–f as shown in FIG. 3. Specifically, the driving power of the servomotor M22 is transmitted to the feeding rollers 22 by the gear "a" mounted on the output shaft of the servomotor M22, bipartite gears b1 and b2 supported by the disk section 21*a*, gears "c" and "d1" on a shaft 23 supported by the disk section 21*a*, and the gears "d2", "e", and "f" housed in the gear housing section 21*b*.

Fixed on the external side wall of the disk section 21*a* of the rotary frame 21 is a wire guide 25 (FIG. 4) for guiding the wire to the entrance of the feeding rollers 22. An intermediate quill 26 is fixed at the front end of the rotary frame 21. The quill 10 supported around an intermediate quill 26 by the slide frame 4 via bearings 12*a* and 12*b* is rotatable relative to the intermediate quill 26. After correction by the guide ring mechanism 29 and the wire correction mechanism 28, the wire 1 is passed through a through-hole 24 of the rotational frame 21, led to the paired feeding rollers 22 via the wire guide 25, passed through the intermediate quill 26, then guided by the quill 10 and fed to the forward wire spring forming stage 100.

The revolving means 30 is formed of the wire feeding means 20 assembled on the slide frame 4 and rotatable as a whole about the axis X1 of the wire 1. That is, the rotary frame 21 constituting the revolving means 30, wire correction mechanism 28, and guide ring mechanism 29 are integrated as a revolving unit U1 (FIGS. 2 and 3), and the rotary frame 21 (disk section 21*a*) located at the front end of the revolving unit U1 is rotatably supported by the slide frame 4 via the cross roller bearings 31. The tailing frame 29*b* of the guide ring mechanism 29 located at the tailing end of the revolving unit U1 is rotatably mounted, via bearings 32, on an L-shaped frame 4*a* that extends rearwardly from the slide table 52.

Mounted on the output shaft of a servomotor M30 installed on the slide table 52 is a pinion gear 34 engaging with a ring gear 33 fixed on the disk section 21*a* of the rotary frame 21, as shown in FIG. 2. Hence, when driven by the servomotor M30, the entire revolving unit U1 (wire feeding means 20) revolves around the axis X1. In this context, the servomotor M30 will be also referred to as revolution servomotor. Thus, a revolution of the wire feeding means 20 around the axis X1 of the wire 1 causes the wire 1 to be twisted, thereby changing the angular position of the wire 1 fed by the quill 10 relative to the spring forming stage 100. Thus, by numerically controlling the angle of revolution of the servomotor M30, the wire 1 on the spring forming stage 100 is twisted to the optimum angular position where it can be engaged with a predetermined one of the radially arranged spring forming tools 120. It will be understood that unlike a conventional spring forming apparatus in which the swivel table is rotated to position the spring forming stage relative to the wire, the spring forming tools 120 of the invention are only advanced to abut on and retreat from the wire fed to the spring forming stage.

As shown in FIGS. 2 and 4, the quill rotating means 40 includes: the quill 10 rotatably supported by the slide frame 4 via bearings 12*a* and 12*b*, a gear 44 provided on, and integrated with, the periphery of the quill 10, an intermediate gear 46 supported by the slide frame 4 to abut on the gear 44, and a pinion gear 48 mounted on the output shaft of a servomotor M40 to engage with the intermediate gear 46. It is noted that the quill 10 can be rotated alone, independently of the revolution of the entire wire feeding means 20 caused by the servomotor M30, to adjust its angular position relative to a predetermined spring forming tool 120 by actuating a servomotor M40.

As shown in FIGS. 1–2, a multiplicity (8 in the example shown herein) of linear slides 110 are provided in a radial arrangement about the center of (the spring forming stage 100 on) the main plate 102 and at right angles to the axis X1 of the wire 1 aligned with the center of the main plate 102. Each of the linear slides 110 is provided with a first servomotor M110 for advancing and retreating a tool slide table 112 mounting thereon one of various types of spring forming tools 120A–120E to and from the spring forming stage 100 located at the leading end of the quill 10. Provided between the output shaft of the servomotor M110 and the tool slide table 112 mounted on the main plate 102 is a crank mechanism 114 for converting the rotational motion of the servomotor M110 into a linear motion, as shown in FIGS. 2, 6, and 9, thereby controlling the advancing and receding motions of the tool slide table 112.

In the example shown herein, spring forming tools 120 include bending tools 120A and 120B used to bend the wire, coil forming tools 120C and 120D for coiling the wire, and a cutting tool 120E for cutting the wire. The cutting tool 120E is a known tool, so that only the bending tools 120A and 120B and the coil forming tools 120C and 120D will be described in detail below.

Rotatably mounted on the backside of the main plate 102 is a ring gear 104, surrounding the spring forming stage 100, as shown in FIGS. 1, 2, 5, and 6. The ring gear 104 is supported by bearings 104*a*, as shown in FIG. 6. The ring gear 104 abuts on a gear 105 mounted on the output shaft of a second servomotor M121. The ring gear 104 is rotated by the second servomotor M121 to rotate rotary bodies 124 of the rotational bending units 121 of the respective bending tools (120A and 120B).

Referring to FIGS. 5–7, there is shown in detail the bending tool 120A. The rotational bending unit 121 mounted on the tool slide table 112 of the bending tool 120A includes a fixed mandrel 123 having a front end facing the axis X1 of the wire 1 and provided with a wire receiving groove 123*a* and a projection 124*a*, adapted to abut on the wire 1, also facing the axis X1 of the wire 1. (In what follows, the projection will be referred to as wire-abutting projection.) The rotational bending unit 121 also includes a rotary body 124 rotatably supported on the periphery of the mandrel 123. A housing 122 is provided on the tool slide table 112 to house the rotational bending unit 121. A driven shaft 125 is rotatably supported in parallel to the fixed central mandrel 123 in the housing 122, as shown in FIG. 6. A gear 125*a* mounted on the driven shaft 125 abuts on a gear 124*b* provided on the periphery of the rear end of the rotary body 124.

The driven shaft 125 is integral with a coaxial spline shaft 126. The spline shaft 126 abuts on a drive shaft in the form of a rotary cylinder 126*a* rotatably mounted on a frame 122*a* fixed on the main plate 102. As a consequence, the spline shaft 126 and the rotary cylinder 126*a* are angularly locked with each other in the spline engagement section 129*a*, so that they can only slide on each other in the axial direction (as indicated by a double arrow in FIG. 6) and can only rotate as a unit. A screw gear 126*b* threaded at 45 degrees and mounted on the rotary cylinder 126*a*, a screw gear 127*a* threaded at 45 degrees and mounted on the vertical rotary shaft 127 for engagement with the screw gear 126*b*, and a pinion 127*b* mounted on the shaft 127 for engagement with the ring gear 104 provided on the backside of the main plate 102 constitutes a power transmission gear mechanism 129. The vertical rotary shaft 127 has a shank support fitted in fixing holes formed in the main plate 102 and adjacent the linear slides 110. The vertical rotary shaft 127 passes through the main plate 102 and vertically extends out of the front end of the main plate 102 so that the rotation of the ring gear 104 is transmitted to the rotary cylinder 126*a* and the driven shaft 125 via the vertical rotary shaft 127 and the screw gears 127*a* and 127*b*, and further to the rotary body 124 via the gears 125*a* and 124*b*.

It is noted that the driving force of the motor M110 is transmitted to the tool slide table 112 via the crank mechanism 114 to advance and retreat the tool slide table 112. But since the rotational bending unit 121 and the driven shaft 125 mounted on the tool slide table 112 by means of the housing 122 can slide in the axial direction in the coupling section (or spline engagement section) 129*a* between the spline shaft 126 integrated with the driven shaft 125 and the rotary cylinder 126*a* supported on the main plate 102 via the frame 122*a*, the tool slide table 112 (and hence the bending tool 120A) can smoothly slide (i.e. advance and retreat) when driven by the servomotor M110.

Thus, as the servomotor M110 is actuated to advance the bending tool 120A and the servomotor M121 is actuated to rotate the rotary body 124 while keeping the wire 1 in engagement with the groove 123*a* of the mandrel 123 as shown in FIG. 7, the portion of the wire 1 held by the wire engaging projection 124*a* is bent at the section which is in engagement with the groove 123*a* of the mandrel 123. It is noted that the wire 1 can be bent either to the right or left depending on the direction of the rotation of the rotary body 124.

Details of the bending tool 120B will be omitted since it has the same structure as the bending tool 120A.

Incidentally, when the ring gear 104 is rotated by the servomotor M121, the rotary body 124, and hence the rotational bending units 121, of the bending tools 120A and 120B are simultaneously rotated. However, in forming a spring, only one (rotary body 125 of the) rotational bending unit 121 of the bending tools 120A or 120B will be used at a time, and the other one will be idling. Therefore, the load of the servomotor M121 is not very large as compared with the load of a tool in which only one (rotary body 124 of the) rotational bending unit 121 is driven. Hence, smooth and swift rotation of (the rotary bodies 124 of) the rotational bending units 121 can be attained to bend the wire 1.

It will be appreciated that the servomotor M121 is disposed at a lower position of the main plate 102 to lower the center of gravity of the main plate 102. This helps reduce the bending torque acting on the main plate 102 due to the weight of the servomotor M121 and hence secure the stability of the main plate 102.

Details of the coil forming tools 120C and 120D are shown in FIGS. 8–10. Each of the coil forming tools 120C and 120D has a tool rotating unit 131 mounted on the tool slide table 112 and having a pair of sinistral and dextral coil forming work heads 134A and 134B, respectively, opposing each other across a rotary shaft 133 for forming a dextral and a sinistral coil, respectively, both heads mounted on a generally planular tool holder 132. The tool holder 132 is a rotary body adapted to rotate about the rotary shaft 133 extending in the direction of the advancing/receding motion of the tool slide table 112. The coil forming tool is also provided with a servomotor M132 for rotating the tool rotating unit 131 (i.e. rotating the tool holder 132). A gear 132*a* mounted on the output shaft of the servomotor M132 abuts on a gear 133*a* mounted on the rotary shaft 133 to transmit the driving power of the servomotor M132.

In the coil forming tool 120C, positions of the sinistral and dextral coil forming work heads 134A and 134B, respectively, can be reversed by simply operating the servomotor M132, so that the sinistral and dextral coil forming work heads 134A and 134B, respectively, can be easily switched on the spring forming stage 100 for engagement with the wire 1.

As shown in FIG. 10, the sinistral and dextral coil forming work heads 134A and 134B, respectively, are provided at the left and the right corners of the tool holder 132, which is a generally planular parallelepiped block, such that the wire engaging faces 136 each having an engaging groove 136*a* are oriented in the opposite directions. Hence, a long coil spring can extend without interfering the tool holder 132 while it is formed.

In forming a coil by fitting the wire 1 in the groove 136*a*, the initial tension of the coil can be adjusted by slightly rotating the tool holder 132 to displace the groove 136*a* by a predetermined (minute) distance. This adjustment initial can be easily attained by numerically controlling the servomotor M132.

The coil forming tool 120D has the same structure as the coil forming tool 120C, that details of the former coil will be omitted.

As described earlier, holes 106 are formed in the main plate 102, at predetermined positions (spaced apart at regular angular intervals) for installing the power transmission gear mechanisms 129 (or the vertical rotary shafts 127) of the respective bending tools, so that the bending tools 120A and 120B can be set up at any one of these angular positions. Thus, a wire spring forming apparatus of the invention has a great design freedom regarding the arrangement of the spring forming tools, thereby making the design of a wire spring forming apparatus easier.

Next, a procedure of forming a wire spring using a wire spring forming apparatus of the invention will now be described with reference to FIGS. 11–16.

FIG. 11 is a perspective view of an exemplary wire spring to be formed. The spring is formed of sections "a–o", beginning with the section "a". FIG. 12 shows an arrangement of the spring forming tools, in which symbols T1–T5 refer to coil forming tools set up at the positions indicated by these symbols. More particularly, symbols T1 and T4 refer to coil forming tools 120C and 120D (having respective work heads) when they are set up at these positions; symbols T2 and T5 refer to bending tools 120B and 120A (equipped with respective work heads) when they are set up at these positions; and T3 refers to a cutting tool 120E (having a cutting work head) when it is set up at this position. In what follows, therefore, a coil forming tool referred to by Tj (j=1 to 5) will be referred to as coil forming tool Tj. In forming a sinistral coil, only the coil forming tool 120C (that includes a sinistral coil forming work head 134A) is used as the coil forming tool T1. In forming a dextral coil, only the coil forming tool 120D (that includes a dextral coil forming work head 134B) is used as the coil forming tool T4. The bending tool 120B is used as a bending tool T2 to form a sinistral spring, while the bending tool 120A is used as a bending tool T5 to form a dextral spring.

Servomotors M110 are arranged at positions M1–M5 (referred to as motors M1–M5) for advancing and retreating the respective tool slide tables 112 mounting thereon respective spring forming tools T1–T5, as shown in FIG. 12. A servomotor M132 is arranged at position M9 (referred to as servomotor M9) to rotate the coil forming tool T1. Servomotors M121 are arranged at positions M10 (referred to as motors M10) to rotate the bending tools T1 and T5. A servomotor M50 is arranged at position M11 (referred to as servomotor M11) to advance and retreat the slide table 52. FIGS. 13–15 together show 15 steps A–O of a process of forming a wire spring. FIG. 16 shows a time sharing scheme applied to the process of forming the wire spring shown in FIG. 11.

To begin with, the servomotor M22 is actuated to drive the feeding rollers to feed a predetermined length of the wire 1 to form the section "a". As the servomotor M5 is actuated to advance the bending tool T5, the groove 123*a* of the mandrel 123 abuts on wire 1. As the servomotor M10 is actuated, the rotary body 124 is rotated to form a kink "b". Then the bending tool T5 is retreated away from the wire 1.

Next, in step B, the wire 1 is rotated in the counterclockwise direction by the revolution servomotor M30 through an angle of 30 degrees while the bending tool T5 is held in the retreated position. During this rotation, a length of wire is further fed out of the quill by the servomotor M22 driving the feeding rollers, thereby forming the section "c".

Next, in step C, the servomotor M5 is actuated to advance the bending tool T5 forward until the groove 123*a* of the mandrel 123 abuts on the wire 1. The servomotor M10 is then actuated to rotate the rotary body 124 to form the bent section "d", after which the bending tool T5 is retreated away from the wire 1.

Next, in step D, the wire 1 is rotated through 90 degrees (+90°) in the counterclockwise direction by the revolution servomotor M30 while keeping the bending tool T5 in the retreated position and feeding the wire 1 by a predetermined length for the section "e" by actuating the feeding roller driving servomotor M22.

Next, in step E, servomotor M5 is actuated to advance the bending tool T5 until the groove 123*a* of the mandrel 123 abuts on the wire 1, and servomotor M10 is actuated to rotate the rotary body 124 to form the section "f". The bending tool T5 is then retreated.

Next, in step F, the revolution servomotor M30 is actuated to rotate the wire 1 through 90 degrees (−90°) in the clockwise direction while keeping the bending tool T5 in the retreated position. Meanwhile, the motor M11 (i.e. servomotor M50 for sliding the slide table 52) is actuated to retreat the quill 10 to a position to form a coil spring of a given diameter. At the same time, the wire 1 is fed out of the quill by a length necessary to form the section "g" by actuating the feeding roller driving servomotor M22.

Next, in step G, the servomotor M1 (servomotor M110 arranged at position M1) is actuated to advance the coil forming tool T1 to a predetermined position. Then, in step H, the wire 1 is fed to form the coil section "h" by actuating the feeding rollers driving servomotor M22 until the wire 1 is coiled for a required number of turns. It is noted that in forming the coil section "h" in steps G, H, and I, the initial tension of the coil to be formed may be adjusted by slightly shifting the work head (or wire engaging groove 136*a*) relative to the wire 1 in the transverse direction of the groove 136*a*. This can be done by actuating the servomotor M9 (or actuating the servomotor M132 to rotate the coil forming tool T1), and hence the tool rotating unit 131 (or tool holder 132). When the coil section "h" is finished by the coil forming tool T1, the coil forming tool T1 is retreated away from the wire 1.

Next, in step J, the wire 1 is rotated in the clockwise direction through 90 degrees (−90°) by the revolution servomotor M30 while keeping the T1 in the retreated position. During this rotation, the quill 10 is advanced to its original position by actuating the servomotor M11 (i.e. servomotor M50 for sliding the slide table 52). At the same time, the wire 1 is fed out of the quill for the length of the section "i" using the feeding rollers driven by the servomotor M22.

Next, in step K, the servomotor MS (servomotor M110 for advancing and retreating the bending tool T5) is actuated to engage the groove 123*a* of the mandrel 123 of the bending tool T5 with wire 1, and then the servomotor M10 (servomotor M121 for rotating the bending tool T5) is actuated to rotate the rotary body 124, thereby forming the kink "j". The bending tool T5 is then retreated away from the wire 1.

Next, in step L, the wire 1 is rotated through 135 degrees (+135°) in the counter clockwise direction by the action of the revolution servomotor M30 while keeping the T5 in the retreated position. During this rotation, a length of the wire 1 is further fed out of the quill by the action of the servomotor M22 driving the feeding rollers, thereby forming the section "k".

In the next step M, the motor M11 (i.e. servomotor M50 for sliding the slide table 52) is actuated to retreat the quill to adjust the axial position of the quill 10. Then, the servomotor M4 (i.e. the servomotor M10) is actuated to advance the coil forming tool T4 until it abuts on the wire 1. When the coil section "l" is finished by continuously feeding the wire 1 by the servomotor 22, the feeding of the wire 1 is stopped and the coil forming tool T4 is retreated away from the wire 1.

In the next step N, the servomotor M22 is actuated to feed the wire 1 for the section "m" while holding the coil forming tool T4 in the retreated position. As the servomotor M2 (i.e. servomotor M110 for advancing and retreating the bending tool T2) is actuated to advance the mandrel 123 to engage the groove 123*a* with the wire 1 and servomotor M10 (i.e. servomotor M121 for rotating the bending tool T2) is actuated to rotate the rotary body 124, forming the kink "n", after which the bending tool T2 is retreated away from the wire 1.

In the next step O, the servomotor M3 (servomotor M22) is driven to feed the wire 1 for the length of the section "1" and servomotor M3 is actuated to advance the wire cutting tool T3 to cut the wire 1, allowing a formed spring shown in FIG. 11 to fall freely under the force of gravity. The wire cutting tool T3 is then retreated away from the wire 1.

Finally, the revolution servomotor M30 is actuated to rotate the wire 1 in the clockwise direction through 30 degrees (−30°) to return the wire 1 to its original position (origin), thereby removing the twist of the wire 1.

It should be understood that, although the coil forming tool T1 is used as a dedicated sinistral tool for sinistral springs and the coil forming tool T4 for dextral springs to avoid switching of the work heads, either one of the coil forming tools T1 or T2 could be used in the spring forming apparatus if the sinistral coil forming work head 134A and dextral coil forming work head 134B were made switchable.

In accordance with the invention, the diameter of the coil to be formed can be easily and arbitrarily altered by adjusting the axial position of the quill using a quill driving means. This is a great advantage of the invention over conventional ones in which the diameter is altered by manually operating adjusting screws.

Particularly, through the numerical control of the servomotors of the wire feeding means, revolving means, and quill moving means as described above, different types of springs having different diameters can be produced at a high production rate.

In accordance with the invention as defined in claim 2, when the quill is utilized as a spring forming guide guiding the wire in the transverse direction and the quill is rotated to an optimum angular position (of a predetermined spring forming tool), the wire can be adequately bent.

Further, in accordance with the invention, each of rotary bodies of multiple bending tools can be rotated by a single servomotor mounted on the main flame that no other motor is needed except for the ones advancing and retreating the slide tables of the respective bending tools.

Also, bending tools can be smoothly advanced and retreated, which allows fast bending operations in the process of wire spring formation. Particularly, when the drive shaft of a bending tool mounted on the main plate has a form of circular cylinder housing therein a driven shaft of a rotational bending unit such that the two shafts are in spline engagement with each other and slidable in the axial direction but locked in the circumferential direction, the shafts allow not only accurate advance and retreat but also an accurate rotation of the bending tool. This enables production of high precision wire springs.

Bending tools may be arranged on the main plate at arbitrary angular positions around the spring forming stage, so that the wire spring forming apparatus has a large design freedom and is easy to design.

The initial tension of a coil to be formed can be easily adjusted by numerically controlling the a third servomotor.

Depending on which of a dextral coil and a sinistral coil is to be formed, a dextral and a sinistral coil forming work heads may be switched by actuating a third servomotor so that a formed coil will not interfere with the tool holder, regardless of the rection of winding of the coil. Consequently, it is possible to provide a coil having a long stem.

SYMBOLS

1 wire X1 axis of wire
2 PLATFORM
3 FIXED FRAME
4 SLIDE UNIT
10 QUILL (WIRE GUIDE)
20 WIRE FEEDING MEANS
21 ROTATIONAL FRAME
21A DISK SECTION OF ROTATIONAL FRAME
22 FEEDING ROLLERS M22 SERVOMOTOR FOR DRIVING FEEDING ROLLERS
30 REVOLVING MEANS
33 RING GEAR CONSTITUTING REVOLVING MEANS M30 SERVOMOTOR FOR REVOLUTION
40 QUILL ROTATING MEANS M40 SERVOMOTOR FOR ROTATING QUILL
50 LINEAR WAY SLIDE (QUILL MOVING MEANS)
52 LINEAR WAY SLIDE TABLE M50 SERVOMOTOR FOR DRIVING LINEAR WAY SLIDE (FOR ADVANCING/RETREATING QUILL)
100 SPRING FORMING STAGE
102 MAIN PLATE
104 RING GEAR CONSTITUTING ROTATIONAL MECHANISM OF BENDING TOOLS
106 HOLES FOR INSTALLING POWER TRANSMISSION GEAR MECHANISM
110 LINEAR SLIDE M110 SERVOMOTOR FOR ADVANCING/RETREATING SPRING FORMING TOOL (FIRST SERVOMOTOR)
112 TOOL SLIDE TABLE
114 CRANK MECHANISM FOR TRANSMITTING POWER OF FIRST SERVOMOTOR TO TOOL SLIDE TABLE
T(120) SPRING FORMING TOOLS
T5(120A) AND T2(120B) BENDING TOOLS
T1(120C) AND T4(120D) COIL FORMING TOOLS
T3(120E) CUTTING TOOL
M121 SERVOMOTOR FOR ROTATING BENDING TOOL (SECOND SERVOMOTOR)
123 FIXED MANDREL CONSTITUTING ROTATIONAL BENDING UNIT
123*a* GROOVE FORMED IN THE FRONT END OF MANDREL TO ABUT ON WIRE
124 ROTARY BODY CONSTITUTING ROTATIONAL BENDING UNIT
124*a* PROJECTION FORMED ON THE FRONT END OF ROTARY BODY TO ABUT ON WIRE
125 DRIVEN SHAFT
126 SPLINE SHAFT OF ROTATIONAL BENDING UNIT SERVING AS DRIVEN SHAFT
127 VERTICAL ROTARY SHAFT
126*a* ROTARY CYLINDER SERVING AS DRIVE SHAFT
129 POWER TRANSMISSION GEAR MECHANISM FOR TRANSMITTING ROTIONAL POWER OF RING GEAR TO ROTARY BODY OF BENDING TOOL
129*a* SPLINE ENGAGEMENT SECTION OF POWER TRANSMISSION GEAR MECHANISM
132 ROTARY TOOL HOLDER FOR MOUNTING THEREON COIL FORMING WORK HEADS M132 SERVOMOTOR FOR ROTATING COIL FORMING TOOL HOLDER (FOR SWITCHING SINISTRAL AND DEXTRAL COIL FORMING WORK HEADS AND ADJUSTING INITIAL TENSION OF WIRE) (THIRD SERVOMOTOR)
134A WORK HEAD FOR FORMING SINISTRAL COIL
134B WORK HEAD FOR FORMING DEXTRAL COIL

The invention claimed is:

1. A spring forming apparatus, comprising:

means for forcibly feeding a linear material having at least a pair of feeding rollers for feeding said material to a spring forming stage via a quill;

revolving means for revolving said feeding rollers about the axis of said linear material to twist the material fed out of the leading end of said quill, thereby changing the circumferential position, or angular position, of said material relative to said spring forming stage;

a multiplicity of spring forming tools arranged radially on said spring forming stage, each of which is movable to and from said linear material in a direction substantially perpendicular to the axis of the linear material, said spring forming tools adapted to be advanced to abut against said material fed to said spring forming stage so as to bend, curve, or turn said material, thereby forming a spring, and a quill moving assembly for controllably moving and affixing said quill to a selected point in the axial direction of said linear material; wherein motions of said feeding means, and revolving means, are controllable.

2. A spring forming apparatus, comprising:

means for forcibly feeding a linear material having at least a pair of feeding rollers for feeding said material to a spring forming stage via a quill;

revolving means for revolving said feeding rollers about the axis of said linear material to twist the material fed out of the leading end of said quill, thereby changing the circumferential position, or angular position, of said material relative to said spring forming stage;

a multiplicity of spring forming tools arranged radially on said spring forming stage, each of which is movable to and from said linear material in a direction substantially perpendicular to the axis of the linear material, said spring forming tools adapted to be advanced to abut against said material fed to said spring forming stage so as to bend, curve, or turn said material, thereby forming a spring, and a quill moving assembly for moving said quill in the axial direction of said linear material; wherein wherein motions of said feeding means, revolving means, and quill moving assembly are controllable; said quill moving assembly includes a linear way slide table; said quill is rotatable about the axis of said linear material by a quill rotating means; and said quill rotating means, feeding means, and revolving means are axially fixed on said linear way slide table.

3. A spring forming apparatus, comprising:

means for forcibly feeding a linear material having at least a pair of feeding rollers for feeding said material to a spring forming state via a quill;

revolving means for revolving said feeding rollers about the axis of said linear material to twist the material fed out of the leading end of said quill, thereby changing the circumferential position, or angular position, of said material relative to said spring forming stage;

a multiplicity of spring forming tools arranged radially on said spring forming stage, each of which is movable to and from said linear material in a direction substantially perpendicular to the axis of the linear material, said spring forming tools adapted to be advanced to abut against said material fed to said spring forming stage so as to bend, curve, or turn said material, thereby forming a spring, and a quill moving means for moving said quill in the axial direction of said linear material;

wherein motions of said feeding means, revolving means, and quill moving means are controllable, and said spring forming tools are radially arranged, and angularly spaced apart at regular angular intervals, on the front end of a main plate that constitutes said spring forming stage, each of said spring forming tools mounted on a tool slide table and driven in the radial direction thereof by a first servomotor via a crank mechanism to an away from said spring forming table;

said main plate having on the backside thereof a rotatably supported ring gear that surrounds said spring forming stage and is driven by a second servomotor mounted on said main plate;

each of the tool slide tables constituting a bending tool provided with a rotational bending unit, and a power transmission gear mechanism is provided between said rotational bending unit and said ring gear to transmit the torque of said ring gear to said rotational bending unit without interfering with advancing and receding motions of said tool slide table.

4. The spring forming apparatus according to claim 3, wherein said power transmission gear mechanism has a drive shaft installed on said main plate in parallel with the sliding direction of said tool slide table and a coaxial driven shaft installed on said rotational bending unit such that said drive shaft and drive shaft are mutually slidable in the coaxial direction but locked in the circumferential direction.

5. The spring forming apparatus according to claim 3, wherein holes for installing said transmission gear mechanisms are formed in the main plate at regular angular intervals.

6. The spring forming apparatus according to claim 3, wherein each of the tool slide tables constituting a coil forming tool is provided with a tool rotating unit having a pair of dextral and sinistral coil forming tools mounted on a rotatable tool holder having a rotary shaft oriented in the direction parallel to the advancing/receding direction of said tool slide table, said coil forming tools opposing each other across said rotary shaft; and further comprising:

a third servometer for rotating said tool holder.

7. The spring forming apparatus according to claim 1, wherein said quill moving assembly includes a linear way slide table.

8. The spring forming apparatus according to claim 7, wherein said quill moving assembly includes a ball screw convicted to said linear way slide table.

* * * * *